United States Patent [19]

Sadahiro

[11] Patent Number: 4,619,552

[45] Date of Patent: Oct. 28, 1986

[54] VIBRATION PROOF SUSPENSION TYPE VIBRATING ROLLER

[75] Inventor: Hisanori Sadahiro, Kawagoe, Japan

[73] Assignee: Sakai Heavy Industries Ltd., Tokyo, Japan

[21] Appl. No.: 638,117

[22] Filed: Aug. 6, 1984

[51] Int. Cl.[4] ..... E01C 19/28

[52] U.S. Cl. ..... 404/117; 404/122; 172/40; 172/97

[58] Field of Search ..... 404/113, 117, 122, 127, 404/128; 172/40, 97; 180/20

[56] References Cited

U.S. PATENT DOCUMENTS

| | | | |
|---|---|---|---|
| 4,362,431 | 12/1982 | Cochran | 404/117 |

FOREIGN PATENT DOCUMENTS

| | | | |
|---|---|---|---|
| 213944 | 3/1961 | Austria | 404/117 |
| 740192 | 8/1966 | Canada | 404/117 |
| 1130537 | 2/1957 | France | 404/117 |
| 29601 | 3/1965 | German Democratic Rep. | 404/117 |
| 1191706 | 5/1970 | United Kingdom | 404/117 |
| 1195108 | 6/1970 | United Kingdom | 404/117 |
| 1251390 | 10/1971 | United Kingdom | 404/117 |
| 1526483 | 9/1978 | United Kingdom | 404/117 |
| 525770 | 3/1977 | U.S.S.R. | 404/117 |

*Primary Examiner*—James A. Leppink

*Assistant Examiner*—John F. Letchford

*Attorney, Agent, or Firm*—Cushman, Darby & Cushman

[57] ABSTRACT

An improved vibration proof suspension type vibrating roller is disclosed which includes a rolling roller rotatably supported in a frame structure, a hydraulic motor for rotating the rolling roller and a hydraulic motor for rotating a vibration generating shaft with an eccentric mass fixedly mounted thereon. A plurality of vibration proof members made of elastic material such as rubber or the like are fixedly secured to both the sides of the frame structure on the inner surface thereof. A hydraulic motor unit including a hydraulic motor for rotating the rolling roller, a plate axle and associated components is fixedly secured to one half member of vibration proof members, while a hydraulic motor unit including a hydraulic motor for rotating the vibration generating shaft, a support plate and associated components is fixedly secured to the other half number of vibration proof members. A bearing case rotatably mounted on the one hydraulic motor unit is bolted to one partition plate and a holder rotatably held in the other hydraulic motor unit is bolted to the other partition plate so that the rolling roller is driven by the one hydraulic motor via a planetary gearing reduction mechanism housed in the bearing case. The output shaft of the other hydraulic motor is connected directly to the vibration generating shaft via coupling means.

9 Claims, 2 Drawing Figures

VIBRATION PROOF SUSPENSION TYPE VIBRATING ROLLER

BACKGROUND OF THE INVENTION

1. Field of the Invention

The present invention relates to a vibration proof suspension type vibrating roller and more particularly to improvement of or relating to a vibrating roller including a rolling roller adapted to roll on the surface of a road such as a paved road or the like.

2. Description of the Prior Art

Requirements for a self-propelled vibrating roller of the above-mentioned type operation on a road surface so that vibratory energy, generated by an eccentric mass, is effectively transmitted to the road surace via the roller, and almost all transmission of vibration to the operator is inhibited. To meet these requirements, the conventional vibrating roller is provided with a plurality of vibration proof (substantially reducing vibration) members in a suspension section with the roller rotatably supported in a frame structure.

However, in a conventional vibrating roller (which includes a vibration proof suspension mechanism(, the vibration generated by the eccentric mass and a spring load are simultaneously transmitted to vibration proof members. For this reason the vibration proof members are required to have high fatigue strength to resist both vibration and spring load forces. In practice, fatigue due to vibration of the roller is negligibly small compared with fatigue due to spring load. Therefore, only fatigue due to spring load is normally taken into consideration.

Because a hydraulic motor for rotating the roller is secured to an axle plate or similar member inside the frame structure of the roller, the vibration proof members are usually fixed to a partition plate in the roller. A coupling means is connected to the output shaft of the hydraulic motor via a support plate, which is between the vibration proof members and the partition plate. Thus, as the roller is rotated by the hydraulic motor, the vibration proof members are also rotated. This rotation causes a spring load to be placed on the vibration proof members opposite in direction to the compression of the spring. Thus, the spring load acts as an alternating load during operation of the roller creating a problem of greatly increasing the fatigue of the vibration proof members.

To solve the foregoing problem, one design was to arrange a number of vibration proof members along a circular track on the partition plate in the roller. This design was intended to distribute the spring load acting on the vibration proof members. However this design causes the roller to be too large and unavoidably complicated in structure. Further, because of required increased fatigue strength and inhibition of vibration due to increased vibratory force the vibrating roller becomes greatly complicated, resulting in the vibration proof suspension mechanism being designed and constructed in disproportionately larger dimensions compared with the whole vibrating roller. Thus, the requirement for designing and constructing of a vibrating roller in smaller dimensions fails to be satisfactorily met by prior designs.

The present invention has been made to substantially overcome the foregoing problems.

SUMMARY OF THE INVENTION

The first object of the present invention is to provide an improved, vibration proof, suspension type vibrating roller. The present invention includes a plurality of vibration proof members secured to the roller's frame which do not rotate during the rolling operation. The design of the subject invention assures that the vibration proof members function stably in the frame structure for a long period of time while maintaining high fatigue strength and excellent dampening of vibration.

The second object of the present invention is to provide an improved vibration proof, suspension type vibrating roller which is designed and constructed in smaller dimensions particularly in the axial direction of the rolling roller.

The third object of the present invention is to provide an improved vibration proof, suspension type vibrating roller which can be manufactured at low cost.

To accomplish the above objects, the present invention provides a vibration proof, suspension type vibrating roller including a roller rotatably supported in a frame structure, a hydraulic motor for rotating the roller and a hydraulic motor for rotating a vibration generating shaft with an eccentric mass securely mounted thereon, the first mentioned hydraulic motor is mounted on one side of the frame structure and the last mentioned hydraulic motor is mounted on the other side of the frame structure. One improvement offered by the present invention is that a plurality of vibration proof members are secured to both sides of the frame structure so as to allow the roller to be rotatably supported by the frame structure by the vibration proof members.

In a preferred embodiment of the invention one half of the vibration proof members are secured to the inner surface of one side of the frame structure and the other half to the vibration proof members are secured to the inner surface of the other side of the frame structure.

Further, a hydraulic motor unit including a hydraulic motor for rotating the, a plate axle and associated components, is secured to the vibration proof members on one side of the frame, while a hydraulic motor unit including a hydraulic motor for rotating the vibration generating shaft, a support plate and associated components is secured to the vibration proof members on the other side of the frame.

Each of the vibration proof members is preferably made of elastic material such as rubber or the like.

Other objects, features and advantages of the invention will become more clearly apparent from reading the following description which has been prepared in conjunction with the accompanying drawings.

BRIEF DESCRIPTION OF THE DRAWINGS

The accompanying drawings will be briefly described below.

DETAILED DESCRIPTION OF THE PREFERRED EMBODIMENT

Figure 1:
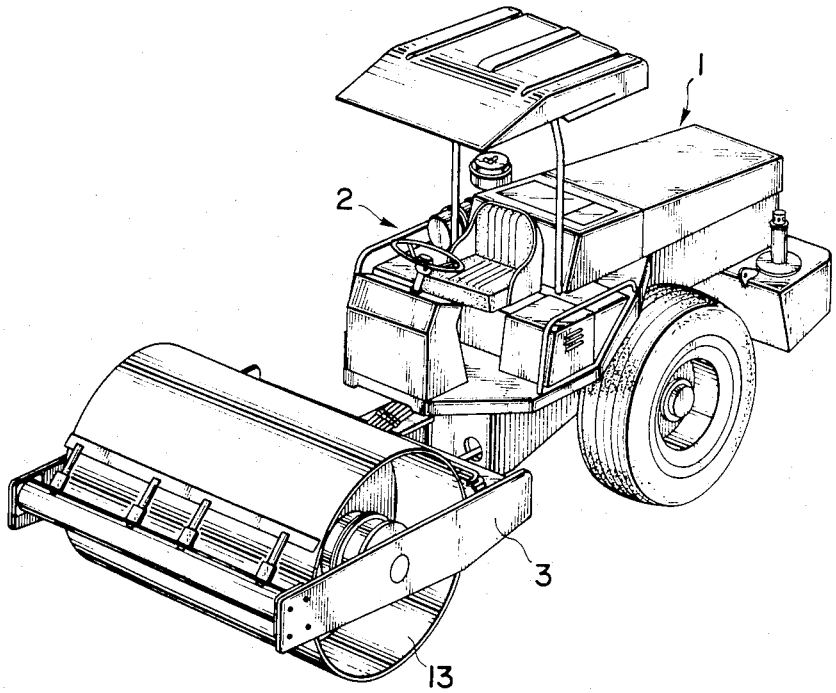
FIG. 1 is a perspective view of a vibrating roller in accordance with an exemplary embodiment of the invention.
Figure 2:
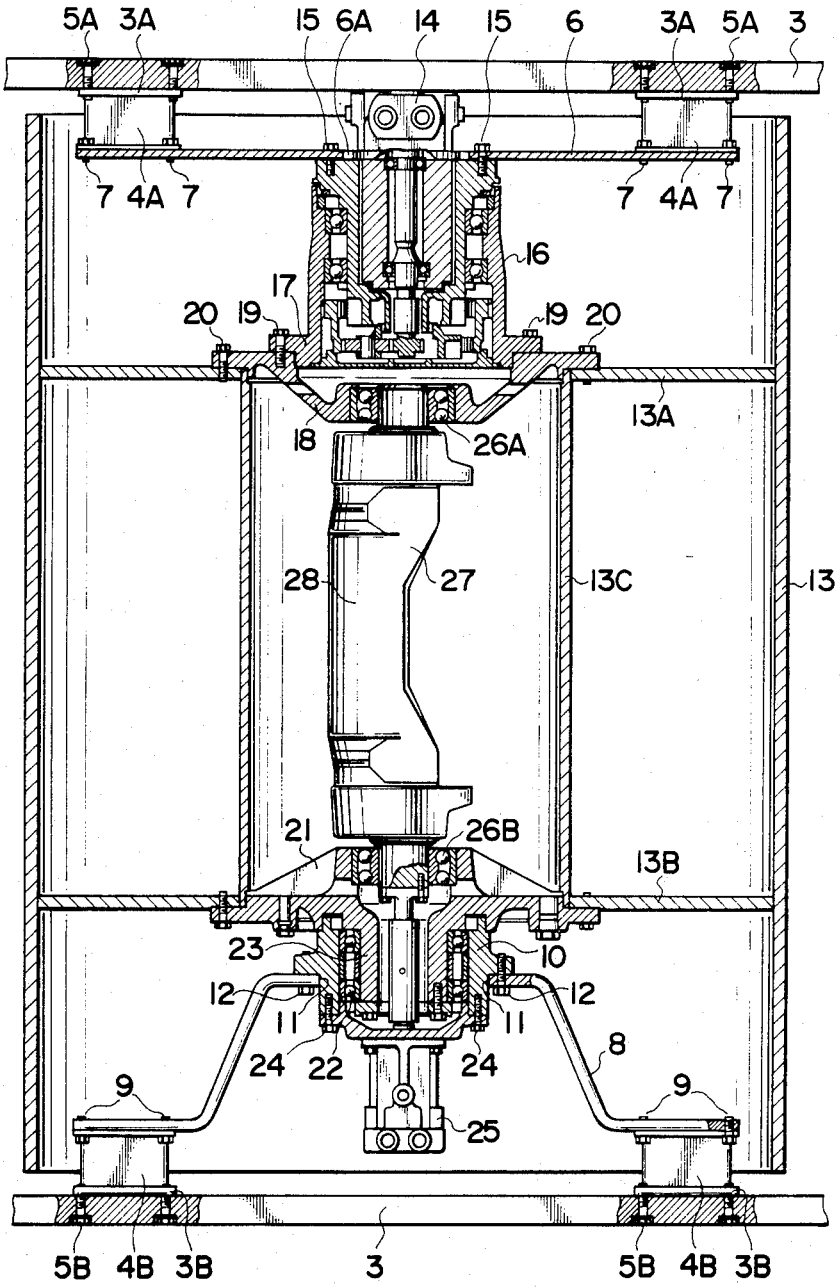
FIG. 2 is a cross-sectional view of a portion of the vibrating roller with a vibration proof mechanisms fitted thereto.

The present invention is described in greater detail hereunder with reference to the accompanying drawings. FIG. 1 shows a main body 1 of the vibrating roller, an engine control section 2, and a frame structure 3 constituting a part of the main body 1 of the vibrating roller. As shown in FIG. 2, the frame structure 3 is equipped with a plurality of vibration proof members 4A and 4B made of rubber or the like elastomeric material. The vibration proof members are firmly secured to both side plates of the frame structure 3, a fixed distance from the periphery of the roller. Specifically, the vibration proof members 4A are securely fitted to the frame structure 3 by bolting their bottom portions 3A to the side plates with the aid of bolts 5A. Further, the vibration proof members 4A are fitted to a plate axle 6 by means of bolts 7.

The vibration proof members 4B having the same structure as that of the vibration proof members 4A, are fitted to the frame structure 3 in the same manner as mentioned above by bolting bottom portions 3B to the other side plate of the frame structure 3 with the aid of bolts 5B. Further, an inverted U-shaped support plate 8 is secured to the vibration proof members 4B by means of bolts 9. A bearing case 10 is firmly fitted into the mounting hole 11 of the support plate 8 by means of bolts 12.

FIG. 2 shows a roller 13 rotatably supported within the frame structure 3. The roller 13 is divided into three chambers in the axial direction by means of partition plates 13A and 13B. The central chamber includes a tubular casing 13C in which a vibration generating shaft 27 is rotatably incased.

The resilient suspension mechanism by which the roller 13 is operatively connected to the frame structure 3 described below.

The plate axle 6 is formed with a fitting hole 6A through which a hydraulic motor 14 for driving the roller 13 is fitted. The hydraulic motor 14 is secured to the plate axle 6 by means of bolts 15. As is apparent from FIG. 2, the hydraulic motor 14 is operatively connected to a planetary gearing mechanism which is housed in a bearing case 16. The flange portion 17 of the bearing case 16 is fixed to a holder 18 by means of bolts 19. Further, the holder 18 is fixed to the partition plate 13A by means of bolts 20. The arrangement of the above-mentioned components allows the roller 13 to roll on the ground or road while vibration is inhibited from being transmitted to the frame structure 3, owing to the existence of a plurality of vibration proof members.

A holder 21, designed in the same manner as the holder 18, is coaxially fixed to the other partition plate 13B of the roller 13 at the position located inside the support plate 8. A coupling section 23 of the holder 21 is housed in the bearing case 10 with bearing 22 disposed therebetween. A hydraulic motor 25 for rotating the vibration generating shaft 27 is securely mounted on the bearing case 10 by means of bolts 24 at a position located outside of the coupling portion 23 of the holder 21. Rotation of the hydraulic motor 25 is transmitted to the vibration generating shaft 27 by way of a sleeve disposed in the coupling section 23 of the holder 21.

The vibration generating shaft 27 is located between the bearing 26A on the holder 18, secured to the partition plate 13A, and the bearing 26B on the holder 21, secured to the other partition plate 13B. The length of the vibration generating shaft 27 is determined by the distance between the bearings 26A and 26B. The vibration generating shaft 27 operatively connected to the hydraulic motor 25 via a coupling sleeve whereby the shaft 27 is rotated by the motor 25. An eccentric mass 28 in the form of an eccentric weight is firmly mounted on the vibration generating shaft 27 so that it is rotated together with the shaft 27.

As the hydraulic motor 14 is actuated, the roller 13 is caused to rotate. As the hydraulic motor 25 is actuated, the vibration generating shaft 27 which is operatively connected to it via the coupling sleeve. Rotation and vibration are simultaneously provided to the roller 13 by mechanisms using both hydraulic motors 14 and 25.

It should of course be understood that both hydraulic motors 14 and 25 are in electric connection to a power supply source (not shown) via the frame structure 3. Further, a mechanism exists enabling both hydraulic motors 14 and 25 to be actuated separately during rolling operation on the ground or road.

Operation vibrating roller of the is described as follows. Prior to initiating operation of the vibrating roller, an operator sits on the seat and then starts the engine. When the hydraulic motor 14 is driven by the operator selectively actuating a control handle, the roller 13 is rotated in the one direction by the hydraulic motor 14. The roller 13 is rotatably supported with the aid of the bearing cases 10 and 16, the plate axle 6 and the support plate 8.

One side of the roller 13, has including the bearing case 16 and flange portion 17, bolted to partition plate 13A. This side of the roller 13 is rotatably supported on the plate axle 6 which is resiliently secured to the frame structure 3, with the vibration proof members 4A disposed therebetween. The other side of the roller 13, has the bearing case 10 bolted to the other partition plate 13B and is rotatably supported on the support plate 8 which is resiliently secured to the frame structure 3 with the vibration proof members 4B. Thus, the roller 13 can move in the predetermined direction smoothly.

When the hydraulic motor 25 is rotated during operation of the roller 13, the vibration generating shaft 27 is rotated in the same direction as that of the hydraulic motor 25 via the coupling sleeve disposed therebetween. Rotational force thus produced is transmitted to the eccentric mass 28 so that the vibration generating shaft 27 is vibrated at a predetermined frequency. Thus, the roller 13 performs a rolling operation simultaneously under the effect of vibratory force.

As shown in FIG. 2, vibration is transmitted to both bearing cases 16 and 22 which are rotatably supported in the frame structure 3 with the vibration free members 4A and 4B. Owing to arrangement, vibration is absorbed into the vibration proof members 4A and 4B, resulting in no vibration being transmitted to the frame structure 3 on either side. Thus, the roller 13 operates without transmission of vibration to an operator who sits on the seat in the cabin.

Because the vibration proof members are attached to both sides of the frame structure 3, there is no possibility of them rotating together with the roller during rolling operation on the ground or road. Accordingly, the vibration proof members are loaded with static vibratory force in the horizontal direction whereby their fatigue is minimized with excellent dampening of vibration.

As described above, the vibrating roller of the invention is constructed such that one hydraulic motor for rotating the roller is operatively connected to one partition plate via a bearing case in which bearing means are housed. the bearing case is resiliently secured to one side of the frame structure with a plate axle and a plurality of vibration members disposed therebetween. The other hydraulic motor for rotating the vibration generating shaft is operatively connected to the other partition plate via a bearing case in which bearing means and coupling means are housed. The bearing case is resiliently secured to the other side of the frame structure with a support plate and a plurality of vibration proof members disposed therebetween. Thus, the vibration proof members are not rotated together with the roller during rolling operation. Further, since the vibration proof members are not rotated together with the roller, there is no change in direction of deflection during rolling operation. Moreover, there is no alternately operative spring load, as in the case of a conventional vibrating roller. Since the vibrating roller is not constructed in the conventional manner where deflection occurs under the effect of static spring load, fatigue of the vibration proof members on either side of the frame structure can be minimized. This means that strength required for the vibration proof members can be greatly reduced.

Thus, one advantageous feature of the invention is that the vibration proof members disposed on both the sides of the frame structure assures that a vibrating roller is effectively protected from the influence of vibration of the rolling roller. Another advantageous features of the invention is that the required ability to resist is reliably maintained, and the whole vibrating roller can be designed and constructed in smaller dimensions particularly by reducing the diameter of the roller.

The vibrating roller of the invention has the following characterizing features.

1. Since hydraulic motor for rotating the roller is disposed in the space defined between the plate axle and the partition plate. A roller support structure is constituted by the plate axle and partition plate on the one side of the frame structure. Thus, a vibration proof suspension mechanism for the vibrating roller can be constructed in smaller dimensions at low cost and moreover, the vibratory roller can be designed and constructed in larger dimensions relative to the vibration proof suspension structure which is designed in smaller dimensions enabled by the overall design of the present invention.

2. Because the hydraulic motor for rotating a roller, bearings and associated components are housed in a single bearing case in the form of an unit, disassembling and reassembling the hydraulic motor can be easily conducted. This is particularly true when a vibratory roller is replaced with a new one for the purpose of repairing or the like. With this in mind, it is possible to manufacture the vibrating roller of the invention at low cost and perform maintenance service without difficulty.

3. Because a power transmission mechanism housed in the bearing casing 16 for the hydraulic motor 14 is designed and constructed in the form of a planetary gearing reduction mechanism, a high reduction ratio can be obtained with a smaller structure. Thus, a smaller hydraulic motor is employable for the vibrating roller of the invention. This leads to low cost manufacturing of the vibrating roller of the invention.

Although only one exemplary embodiment of this invention has been described in detail above, those skilled in the art will recognize that many modifications and variations may be made in this exemplary embodiment while yet retaining many of the novel advantages and features of this invention. Accordingly, all such modifications and variations are intended to be included within the scope of the appended claims.

What is claimed is:

1. A vibrating roller comprising:

a frame structure having first and second sides; and a vibratory roller including, a roller of generally cylindrical shape having first and second ends, and being supported in said frame structure, said roller including a plate member disposed at said first end of said roller, said plate member having a first side closer to said frame and a second side further from said frame, a plurality of substantially vibration proof members directly fixed to both of said sides of said frame structure and securing both of said ends of said roller so as to enable said roller to be rotatably supported by said frame structure via said members, said vibration proof members securing said first end of said roller, being attached to said first side of said plate member, a first hydraulic motor for rotating said vibratory roller, being mounted on said first side of said frame structure and on said first side of said plate member, said first hydraulic motor having a drive gear mechanism including a housing located on and fixed to said second side of said plate member, a vibration generating shaft having an eccentric mass secured thereto, and being generally located along the longitudinal axis of said roller, and a second hydraulic motor for rotating said vibration generating shaft, being mounted on said second side of said frame structure.

2. A vibrating roller as claimed in claim 1 wherein the number of said substantially vibration proof members which are secured to said first side of said frame structure equal the number of said substantially vibration proof members which are secured to said second side of said frame structure.

3. A vibrating roller as claimed in claim 1 wherein the longitudinal axis of said roller, said vibration generating shaft, and said first and second hydraulic motors are all arranged on the generally same line.

4. A vibrating roller as claimed in claim 1 wherein said substantially vibration proof members are made of elastic material.

5. A vibrating roller as claimed in claim 4 wherein said substantially vibration proof members are made of rubber.

6. A vibrating roller comprising:

a frame structure having first and second sides;

a vibratory roller including;

a roller of generally cylindrical shape having first and second ends, and being supported in said frame structure, said roller including a plate member disposed at said first end of said roller said plate member having a first side closer to said frame and a second side further from said frame, a plurality of substantially vibration proof members directly fixed to both of said sides of said frame structure and securing both of said ends of said roller so as to enable said roller to be rotatably supported by said frame structure via said members, said vibration proof members securing said first end of said roller, being attached to said first side of said plate member, a first hydraulic motor for rotating said vibratory roller, being mounted on said first side of said frame structure and on said first side of said plate member, said first hydraulic motor having a drive gear mechanism including a housing located on and fixed to said second side of said plate member, a vibration generating shaft having an eccentric mass secured thereto, and being generally located along the longitudinal axis of said roller, a second hydraulic motor for rotating said vibration generating shaft, being mounted on said second side of said frame structure, and on the longitudinal axis of said roller, said vibration generating shaft, and said first and second hydraulic motors are all arranged on the generally same line.

7. A vibrating roller as claimed in claim 6 wherein the number of said substantially vibration proof members which are secured to said first side of said frame structure equal the number of said substantially vibration proof members which are secured to said second side of said frame structure.

8. A vibrating roller as claimed in claim 6 wherein said substantially vibration proof members are made of elastic material.

9. A vibrating roller as claimed in claim 8 wherein said substantially vibration proof members are made of rubber.

* * * * *